US010239082B1

(12) United States Patent
Elliott

(10) Patent No.: US 10,239,082 B1
(45) Date of Patent: Mar. 26, 2019

(54) APPARATUS FOR THE REPAIR OF DAMAGED OR BENT AIRBRUSH NEEDLES

(71) Applicant: Chad Elliott, Highland Village, TX (US)

(72) Inventor: Chad Elliott, Highland Village, TX (US)

( * ) Notice: Subject to any disclaimer, the term of this patent is extended or adjusted under 35 U.S.C. 154(b) by 0 days.

(21) Appl. No.: 15/959,435

(22) Filed: Apr. 23, 2018

Related U.S. Application Data

(63) Continuation of application No. 15/839,925, filed on Dec. 13, 2017, now Pat. No. 10,029,272.

(51) Int. Cl.
*B05B 15/14* (2018.01)
*B05B 7/02* (2006.01)

(52) U.S. Cl.
CPC ..... *B05B 15/14* (2018.02); *B05B 7/02* (2013.01)

(58) Field of Classification Search
CPC ..... B05B 15/14; B05B 7/02; B24D 15/08; B24B 3/36; B24B 5/48; B24B 5/485; B24B 19/00; B24C 51/005
See application file for complete search history.

(56) References Cited

U.S. PATENT DOCUMENTS 1,202,325 A 10/1916 Simmons
2,613,645 A 10/1952 Von Kameniczky
2,851,009 A 9/1958 Branvold
3,698,140 A * 10/1972 Steadman ..... B24B 3/265 451/349
3,698,456 A 10/1972 Cho
3,755,970 A * 9/1973 Parr ..... B24B 3/36 451/163
3,973,604 A 8/1976 Lincoln
4,054,164 A 10/1977 Kose
4,676,028 A 6/1987 Kaczmarski
4,815,507 A 3/1989 O'Rourke
5,735,732 A * 4/1998 Bernard ..... B24B 3/247 279/60
6,106,372 A * 8/2000 Clark ..... B24B 19/16 451/45
9,022,839 B2 5/2015 Colasurdo
2007/0054604 A1* 3/2007 Scott ..... B24D 15/06 451/45

FOREIGN PATENT DOCUMENTS

GB 2171939 9/1986

* cited by examiner

*Primary Examiner* — Dung Van Nguyen

(74) *Attorney, Agent, or Firm* — James M. Smedley LLC; James Michael Smedley, Esq.

(57) ABSTRACT

The present invention generally relates to an apparatus for repairing damaged or bent airbrush needles. Specifically, embodiments of the present invention are directed to an apparatus comprising one or more sharpening stones of various grits configured to allow for the sharpening of airbrush needles with precision.

19 Claims, 5 Drawing Sheets

APPARATUS FOR THE REPAIR OF DAMAGED OR BENT AIRBRUSH NEEDLES

RELATED APPLICATIONS

This application is a continuation application of, and thereby claims the benefit of, U.S. Nonprovisional patent application Ser. No. 15/839,925, filed Dec. 13, 2017, which is hereby incorporated by reference in its entirety.

FIELD OF THE INVENTION

The present invention generally relates to an apparatus for repairing damaged or bent airbrush needles. Specifically, embodiments of the present invention are directed to an apparatus comprising one or more sharpening stones of various grits configured to allow for the sharpening of airbrush needles with precision.

BACKGROUND

The airbrush fluid needle is the one component of the airbrush gun that enables a user to achieve the finest of detail in any creation. It is the most crucial element of an airbrush gun in regards to the quality and detail an artist is able to produce. If the integrity of an airbrush fluid needle is compromised in any way, the spray pattern is disrupted and the airbrush gun as a whole is no longer workable. The user is unable to generate detail which diminishes the quality of work.

There are currently no known apparatuses or methods for providing airbrush fluid needle sharpening. Prior to this invention, bent airbrush needle solutions mainly consisted of home remedies such as sliding the bent needle through two coins, two pieces of metal or wood. Other methods included attempts at using hand-held drills and sandpaper to repair damaged or bent airbrush fluid needles. These rudimentary home remedies produce varying results that often generate a less-than-perfect outcome.

The consequences of a damaged or bent airbrush needle are extremely detrimental due to added cost, time, and opportunity loss. Users are often left with no other alternative but to buy a new needle. Options can be limited in certain areas and many users are forced to order specific needles online, resulting in a loss of several days of work as well as incurrence of additional costs.

Therefore, there is a need in the art for an apparatus for repairing and/or sharpening bent or damaged airbrush needles. These and other features and advantages of the present invention will be explained and will become obvious to one skilled in the art through the summary of the invention that follows.

SUMMARY OF THE INVENTION

Accordingly, it is an aspect of the present invention to provide an apparatus for the repair of damaged or bent airbrush needles. The apparatus being capable of repairing damaged or bent airbrush needles.

According to an embodiment of the present invention, an apparatus for the repair of damaged or bent airbrush needles, said apparatus comprising: a sharpener housing comprising an outer body shell, at least one sharpening stone and at least one metal base plate; and at least one airbrush fluid needle insertion housing connected to said sharpener housing, wherein said airbrush fluid needle insertion housing is an elongated body with an opening formed on an end opposite to the side of said connection to said sharpener housing, said opening connected to a channel passing through an interior length of the airbrush fluid needle insertion housing and into an interior chamber of the sharpener apparatus housing, wherein said opening is intended to receive an air brush fluid needle and allow passage of at least a portion of said air brush fluid needle through the channel and into the interior chamber of the sharpener apparatus housing so that the air brush fluid needle may engage with said sharpening stone and said metal base plate.

According to an embodiment of the present invention, the apparatus for the repair of damaged or bent airbrush needles further comprising a sharpener apparatus securing means.

According to an embodiment of the present invention, the securing means is formed upon said sharpener apparatus housing and secures the sharpener apparatus housing in a closed position when engaged and allows for the sharpener apparatus housing to be opened when disengaged.

According to an embodiment of the present invention, the apparatus for the repair of damaged or bent airbrush needles further comprising a plate securing means.

According to an embodiment of the present invention, the plate securing means is formed upon said airbrush fluid needle insertion housing and secures the airbrush fluid needle insertion housing in a closed position when engaged and allows for the airbrush fluid needle insertion housing to be opened when disengaged.

According to an embodiment of the present invention, a sharpener housing comprising an outer body shell, at least one sharpening stone and at least one metal base plate; and a plurality of airbrush fluid needle insertion housings connected to said sharpener housing, wherein each airbrush fluid needle insertion housing comprises an elongated body with an opening formed on an end opposite to the side of said connection to said sharpener housing, said opening connected to a channel passing through an interior length of the airbrush fluid needle insertion housing and into an interior chamber of the sharpener apparatus housing, wherein said opening is intended to receive an air brush fluid needle and allow passage of at least a portion of said air brush fluid needle through the channel and into the interior chamber of the sharpener apparatus housing so that the air brush fluid needle may engage with said sharpening stone and said metal base plate.

According to an embodiment of the present invention, each airbrush fluid needle insertion housings of said plurality of airbrush fluid needle insertion housings is connected to said sharpener apparatus housing at a different angle from the other airbrush fluid needle insertion housings.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
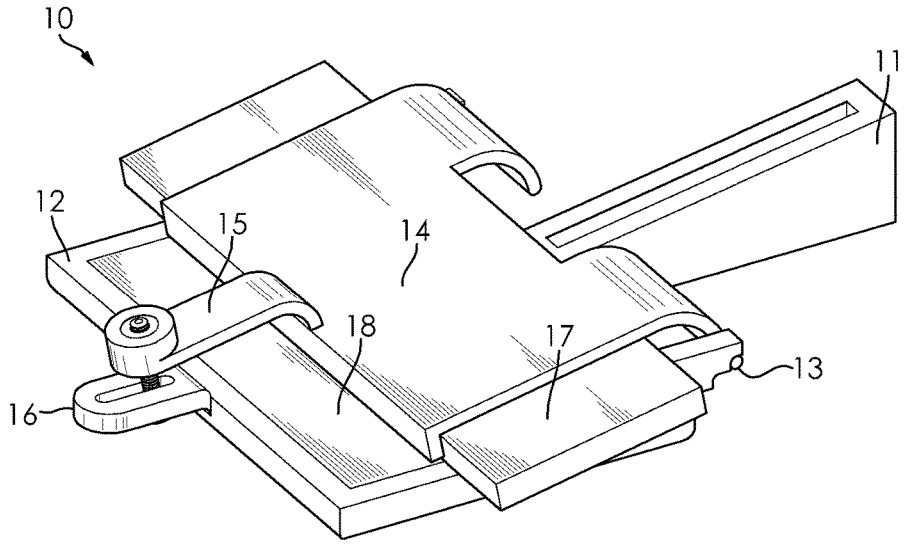
FIG. 1 is a front perspective view of an apparatus for the repair of damaged or bent airbrush needles in accordance with a first embodiment of the present invention.

The present invention generally relates to an apparatus for repairing damaged or bent airbrush needles. Specifically, embodiments of the present invention are directed to an apparatus comprising one or more sharpening stones of various grits configured to allow for the sharpening of airbrush needles with precision.

According to embodiments of the present invention, an apparatus for the repair of damaged or bent airbrush needles allows users to effortlessly restore an airbrush needle to its original condition or near original condition. The apparatus is outfitted with multiple sharpening stones of varying grits allowing the user to remedy the damaged needle with precision. In addition to multiple stones, the sharpening tool also utilizes various angles in an effort to enhance accuracy. In a preferred embodiment comprising a manually operated version of the apparatus, the simplistic design allows for quick utilization which is an added benefit to users.

According to embodiments of the present invention, manual versions of the design are produced using plastic injection molding which makes up a substantial portion of the main piece design as well as metal or ceramic portions including the sharpening stones and/or a metal base plate. A variety of metals may be applicable including aluminum and steel. While preferred embodiments may be constructed in this manner, one of ordinary skill in the art would appreciate that numerous substitutions and manufacturing methods could be substituted without departing from the spirit of the invention described herein, and all methods and substitutions which would be obvious to one of ordinary skill in the art, while not necessarily enumerated, are contemplated herein.

According to an embodiment of the present invention, an apparatus for the repair of damaged or bent airbrush needles is comprised of separate pieces which are joined together with adjustable pivots enabling the user to achieve the desired angle. A manually operated design enables the user to apply varying angles and grits to a damaged airbrush fluid needle beginning with the broadest angle working down to the narrowest angle. The hand tool provides the correct angle for the airbrush fluid needle to seat properly into the airbrush fluid nozzle.

According to another embodiment of the present invention, the apparatus may be comprised of a plurality of sections, each providing a specific angle and grit. In this embodiment, a user may utilize one or more of the sections, as necessary, in order to repair the airbrush fluid needle. The user may end up using multiple sections of the plurality of sections (e.g., broadest angle to narrowest angle) in order to fully repair the airbrush fluid needle.

In yet another embodiment of the present invention, the apparatus may be comprised of a plurality of sections with adjustable angles and grit, such as by way of one or more adjustable pivot joints. Similar to the previous two embodiments, the user may end up using multiple sections and/or adjust one or more of the adjustable pivot joints of the plurality of sections (e.g., broadest angle to narrowest angle) in order to fully repair the airbrush fluid needle.

Figure 2:
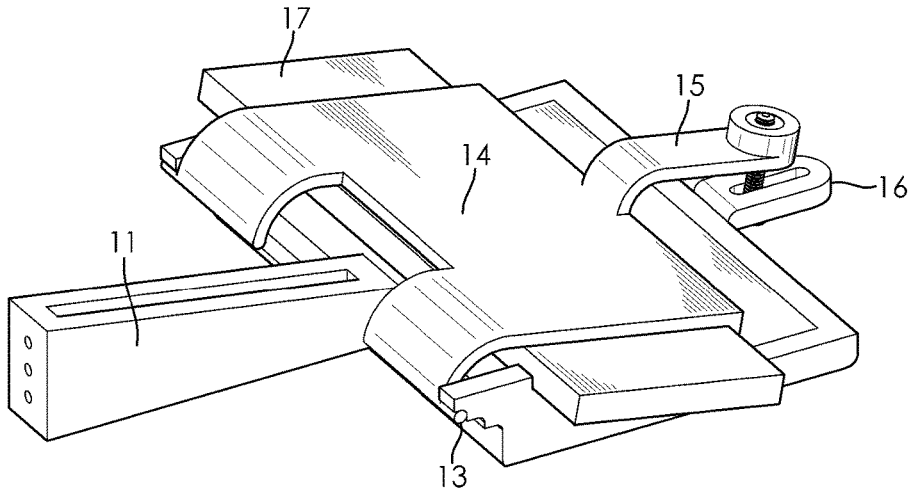
FIG. 2 is a rear perspective view of an apparatus for the repair of damaged or bent airbrush needles in accordance with a first embodiment of the present invention.
Figure 3:
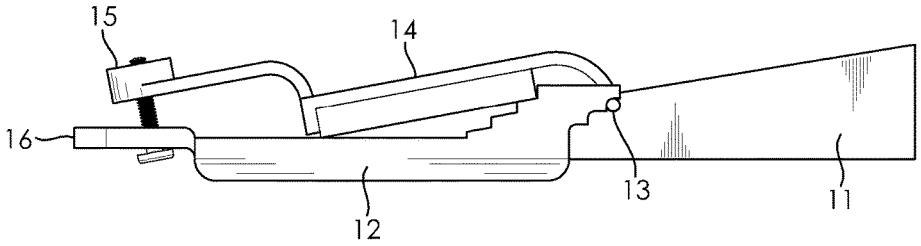
FIG. 3 is a side view of an apparatus for the repair of damaged or bent airbrush needles in accordance with a first embodiment of the present invention.
Figure 4:
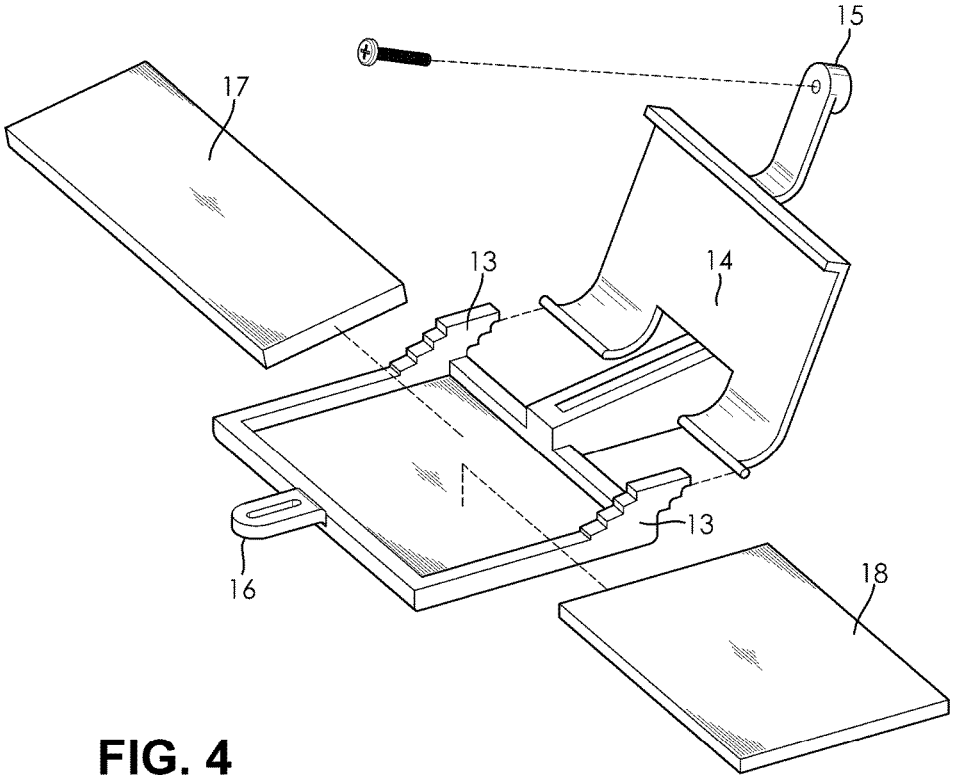
FIG. 4 is an exploded perspective view of an apparatus for the repair of damaged or bent airbrush needles in accordance with a first embodiment of the present invention.

Turning now to FIGS. 1-4, an exemplary embodiment of the present invention is shown. In this embodiment, the apparatus 10 is comprised of a handle 11, a base plate 12, one or more adjustable pivot joints 13, a top plate 14, a top plate securing means 15, a bottom plate securing means 16 a sharpening stone 17 and a metal base plate 18. In this embodiment, the handle 11 attaches to a rear portion of base plate 12. The one or more adjustable pivot joints 13 are formed upon a rear side of the base plate 12 and are formed to engage a portion of said top plate 14 such that when the top plate 14 is engaged with one or more of said one or more adjustable pivot joints 13, the top plate 14 may pivot to various angles while maintaining engagement with the bottom plate.

A top plate securing means 15, being formed upon the top plate 14, engages with bottom plate securing means 16, being formed upon the base plate 12, in order to secure the top plate 14 to the bottom plate. This allows the apparatus to be moved to various angles by providing the ability for the apparatus to be locked in a particular angle by the securing means 15 and 16, but be loosened or removed in order to move to another angle, as permitted by the various adjustable pivot joints 13. A user simply needs to move between positions provided by the adjustable pivot joints 13 in order to achieve a new angle for sharpening the airbrush fluid needle.

While FIGS. 1-4 depict an exemplary embodiment of the present invention, alternative embodiments may contain various alterations and configurations, all within the spirit and scope of the present disclosure. For instance, while depicted in the figures with only one securing means, the top plate and bottom plate could include one or more securing means. Further, while the figures show the bottom plate securing means as an elliptical channel integrally formed upon the bottom plate from a u shaped wall, and the top plate securing means 15 as an arm extending from the top plate with a threaded section for receiving a screw or screw and nut, one of ordinary skill in the art would appreciate that the bottom plate securing means and top plate securing means could be selected from any number of appropriate securing means, including, but not limited to, fasteners, clips, bolts and nuts, pins, push-lock fasteners, twist-lock fasteners, as well as structures capable of receiving or engaging with any the aforementioned fasteners, clips, bolts, pins, or other securing means. Embodiments of the present invention are contemplated for use with any appropriate type of securing means for the top plate and/or bottom plate.

Figure 5:
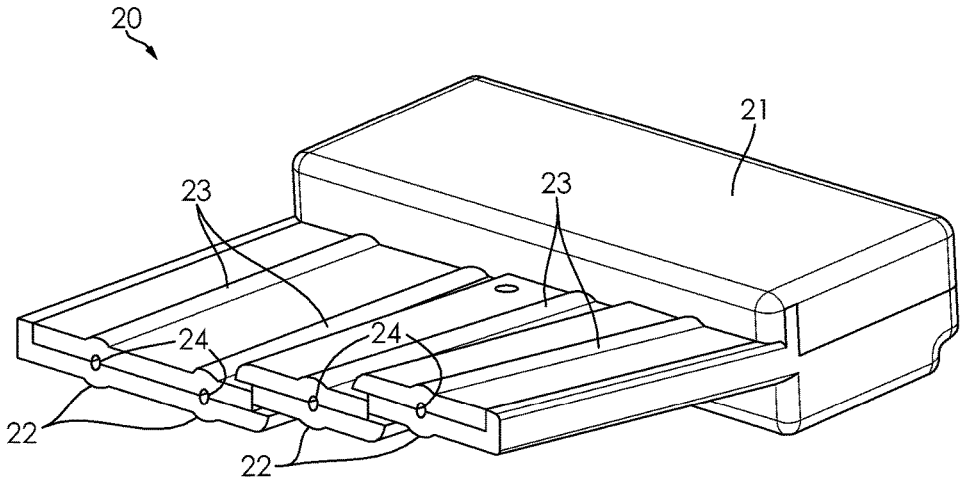
FIG. 5 is a front perspective view of an apparatus for the repair of damaged or bent airbrush needles in accordance with a first embodiment of the present invention.
Figure 6:
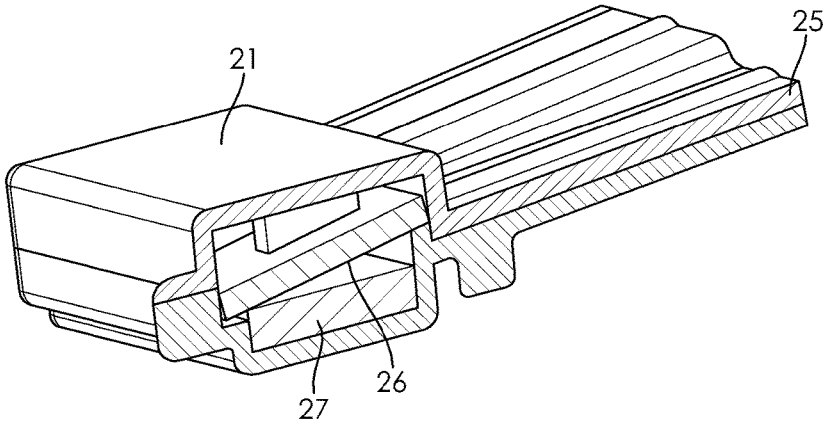
FIG. 6 is a cross-sectional view of an apparatus for the repair of damaged or bent airbrush needles in accordance with a first embodiment of the present invention.
Figure 7:
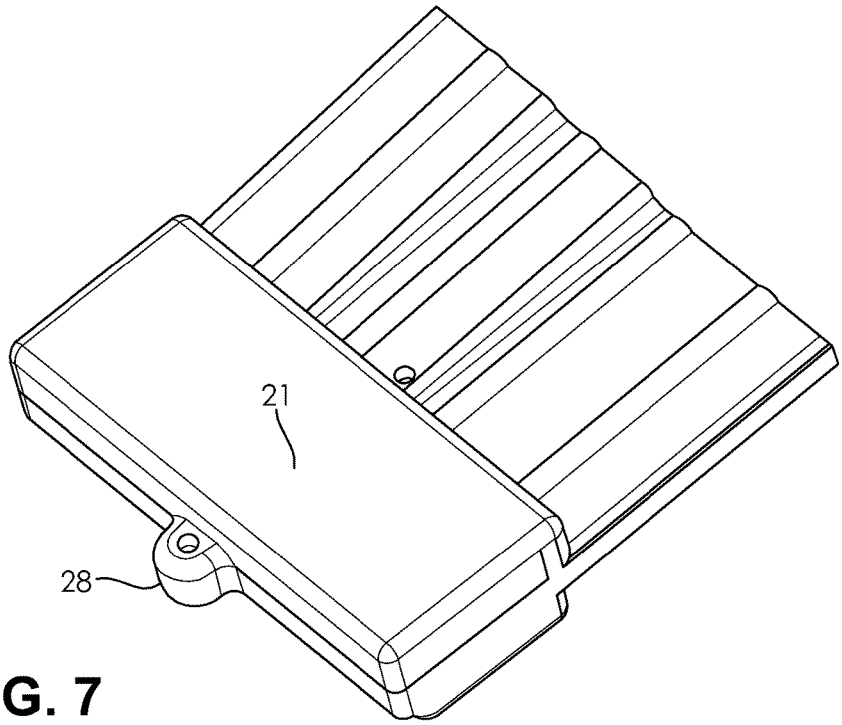
FIG. 7 is a front perspective view of an apparatus for the repair of damaged or bent airbrush needles in accordance with a first embodiment of the present invention.
Figure 8:
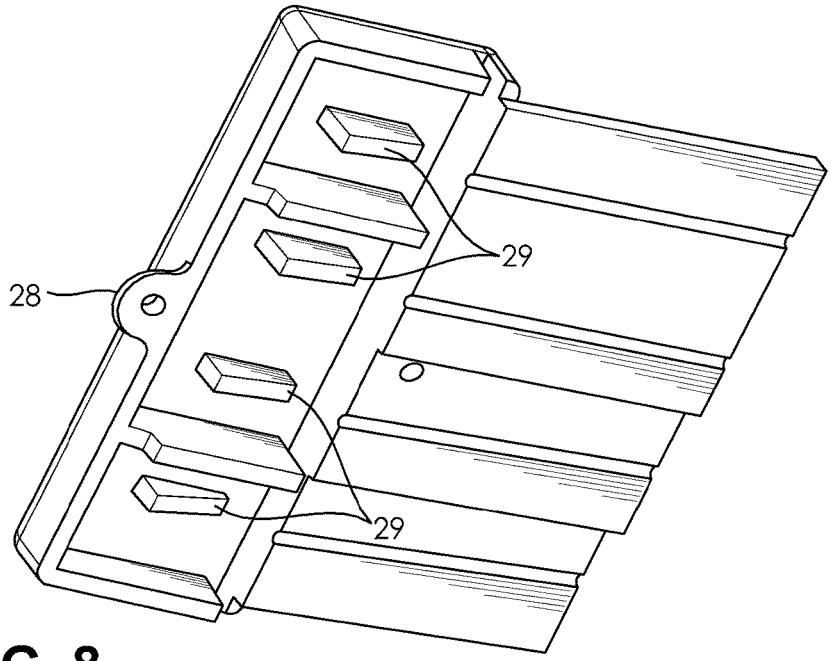
FIG. 8 is a bottom perspective view of an apparatus for the repair of damaged or bent airbrush needles in accordance with a first embodiment of the present invention.
Figure 9:
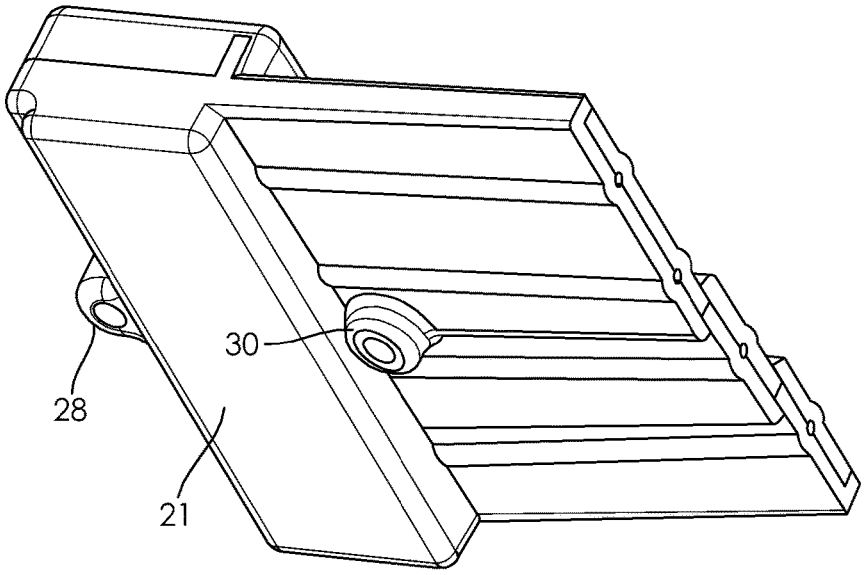
FIG. 9 is a front perspective view of an apparatus for the repair of damaged or bent airbrush needles in accordance with a first embodiment of the present invention.

Turning now to FIGS. 5-9, an exemplary embodiment of the present invention is shown. In this embodiment, a sharpener apparatus housing 21 is shown with multiple airbrush fluid needle insertion housings. The airbrush fluid needle insertion housings comprising lower plates 22 and upper plates 23 fitted together and forming an opening 24 and channel 25 that passes through the interior length of the airbrush fluid needle insertion housing. The channel 25 passes from the opening 24 through into an interior of the sharpener apparatus housing 21. Inside the sharpener apparatus housing, there are a plurality of sharping stones 26 and metal base plates 27. Portions of the apparatus may be secured together by a sharpener apparatus housing securing means 28 and/or a plate securing means 30.

Further, inside the sharpener apparatus housing 21, there are one or more angling elements 29, configured to angle the sharpening stones 26 in such a manner to contact with the metal base plates 27 in order to provide specific angles of sharpening for airbrush fluid needles inserted into the corresponding channel 25. With multiple channels, providing multiple angles, a user can simply use the channels required to fix a given airbrush fluid needle, by inserting the airbrush fluid needle into the appropriate channel or channels and engaging the airbrush fluid needle against the sharpening stones 26 and/or metal base plates 27.

While FIGS. 5-9 show a sharpener apparatus with multiple channels, embodiments of the present invention could be comprised of a sharpener apparatus housing with a single channel. Further, embodiments of the present invention could utilize an integrated lower plate and upper plate, forming a single unitary plate with a channel running through it and opening at each end. In still further embodiments, a sharpener apparatus may be formed in a single unit, eliminating the need for housing securing plate means and/or plate securing means.

Further, while FIGS. 1-9 depict embodiments of the present invention, alterations in size, shape, connections, points for connections and joints, and other components could be altered or rearranged. Such variations are contemplated for use with embodiments of the present invention. The figures are therefore provided for illustrative effect and not intended to be limiting.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. An apparatus, comprising:

a sharpener housing;

a first sharpening stone disposed in the sharpener housing at a first angle;

a second sharpening stone disposed in the sharpener housing at a second angle that is different from the first angle;

at least one airbrush needle insertion housing attached to the sharpener housing and having at least one channel configured to receive an airbrush needle; and a sharpener apparatus securing assembly that is formed upon the sharpener housing and that secures the sharpener housing in a closed position when engaged and allows for the sharpener housing to be opened when disengaged.

2. The apparatus of claim 1, wherein the at least one channel includes a first channel that is disposed at a first height relative to the sharpener housing, and a second channel that is disposed at a second height relative to the sharpener housing, the first height being different from the second height.

3. The apparatus of claim 2, wherein the first channel is aligned with the first sharpening stone and the second channel is aligned with the second sharpening stone.

4. The apparatus of claim 1, wherein the at least one airbrush needle insertion housing includes a first airbrush needle insertion housing having a first channel that is disposed at a first height relative to the sharpener housing, and a second airbrush needle insertion housing having a second channel that is disposed at a second height relative to the sharpener housing.

5. An apparatus for the repair of damaged or bent airbrush needles, said apparatus comprising:

a sharpener housing including an outer body shell, at least one sharpening stone and at least one base plate; and at least one airbrush fluid needle insertion housing connected to said sharpener housing, wherein said airbrush fluid needle insertion housing is an elongated body with an opening formed on an end opposite to the side of said connection to said sharpener housing, said opening connected to a channel passing through an interior length of the airbrush fluid needle insertion housing and into an interior chamber of the sharpener apparatus housing, wherein said opening is configured to receive an air brush fluid needle and allow passage of at least a portion of said air brush fluid needle through the channel and into the interior chamber of the sharpener apparatus housing so that the air brush fluid needle may engage with said sharpening stone and said base plate.

6. The apparatus for the repair of damaged or bent airbrush needles of claim 5, further comprising a sharpener apparatus securing assembly.

7. The apparatus for the repair of damaged or bent airbrush needles of claim 6, wherein said securing assembly is formed upon said sharpener apparatus housing and secures the sharpener apparatus housing in a closed position when engaged and allows for the sharpener apparatus housing to be opened when disengaged.

8. The apparatus for the repair of damaged or bent airbrush needles of claim 5, further comprising a plate securing assembly.

9. The apparatus for the repair of damaged or bent airbrush needles of claim 8, wherein said plate securing assembly is formed upon said airbrush fluid needle insertion housing and secures the airbrush fluid needle insertion housing in a closed position when engaged and allows for the airbrush fluid needle insertion housing to be opened when disengaged.

10. An apparatus, comprising:

a sharpener housing;

a first sharpening stone disposed in the sharpener housing at a first angle;

a second sharpening stone disposed in the sharpener housing at a second angle that is different from the first angle;

at least one airbrush needle insertion housing attached to the sharpener housing and having at least one channel configured to receive an airbrush needle; and a plate securing assembly that is formed upon the at least one airbrush needle insertion housing and that secures the at least one airbrush needle insertion housing in a closed position when engaged and allows for the at least one airbrush needle insertion housing to be opened when disengaged.

11. The apparatus of claim 10, wherein the at least one channel includes a first channel that is disposed at a first height relative to the sharpener housing, and a second channel that is disposed at a second height relative to the sharpener housing, the first height being different from the second height.

12. The apparatus of claim 11, wherein the first channel is aligned with the first sharpening stone and the second channel is aligned with the second sharpening stone.

13. The apparatus of claim 10, wherein the at least one airbrush needle insertion housing includes a first airbrush needle insertion housing having a first channel that is disposed at a first height relative to the sharpener housing, and a second airbrush needle insertion housing having a second channel that is disposed at a second height relative to the sharpener housing.

14. An apparatus, comprising:

a sharpener housing;

a first sharpening stone disposed in the sharpener housing at a first angle;

a second sharpening stone disposed in the sharpener housing at a second angle that is different from the first angle; and at least one airbrush needle insertion housing attached to the sharpener housing and having at least one channel configured to receive an airbrush needle;

wherein the first sharpening stone is disposed in the sharpener housing at the first angle based on being supported between a first base plate and a first angled member that is angled at the first angle, and the second sharpening stone is disposed in the sharpener housing at the second angle based on being supported between a second base plate and a second angled member that is angled at the second angle.

15. The apparatus of claim 14, wherein the at least one channel includes a first channel that is disposed at a first height relative to the sharpener housing, and a second channel that is disposed at a second height relative to the sharpener housing, the first height being different from the second height.

16. The apparatus of claim 15, wherein the first channel is aligned with the first sharpening stone and the second channel is aligned with the second sharpening stone.

17. The apparatus of claim 14, wherein the at least one airbrush needle insertion housing includes a first airbrush needle insertion housing having a first channel that is disposed at a first height relative to the sharpener housing, and a second airbrush needle insertion housing having a second channel that is disposed at a second height relative to the sharpener housing.

18. The apparatus of claim 14, further comprising a plate securing assembly that is formed upon the at least one airbrush needle insertion housing and that secures the at least one airbrush needle insertion housing in a closed position when engaged and allows for the at least one airbrush needle insertion housing to be opened when disengaged.

19. The apparatus of claim 14, further comprising a sharpener apparatus securing assembly that is formed upon the sharpener housing and that secures the sharpener housing in a closed position when engaged and allows for the sharpener housing to be opened when disengaged.

* * * * *